United States Patent [19]

Bell

[11] Patent Number: 4,719,665

[45] Date of Patent: Jan. 19, 1988

[54] DOUBLE PIVOT HINGE

[75] Inventor: Gregory E. Bell, Roseville, Mich.

[73] Assignee: General Motors Corporation, Detroit, Mich.

[21] Appl. No.: 940,739

[22] Filed: Dec. 11, 1986

[51] Int. Cl.[4] ..... E05D 11/06; E05D 11/10; E05F 3/20

[52] U.S. Cl. ..... 16/232; 16/50; 16/321; 16/324; 16/333; 16/343; 16/349; 16/366; 16/371; 49/192; 296/146

[58] Field of Search ..... 16/231, 232, 319, 324, 16/333, 343, 346, 349, 366, 371, 374, 50, 321; 49/247, 192; 296/146

[56] References Cited

U.S. PATENT DOCUMENTS

| | | | |
|---|---|---|---|
| 2,870,477 | 1/1959 | Anthony et al. | 16/366 |
| 3,519,300 | 7/1970 | McKey | 16/232 |
| 3,551,941 | 1/1971 | Bruers | 16/371 |
| 4,242,773 | 1/1981 | Beigh | 16/371 |
| 4,495,674 | 1/1985 | Haddock, Jr. | 16/371 |
| 4,655,499 | 4/1987 | Piper | 16/366 |

*Primary Examiner*—Nicholas P. Godici
*Assistant Examiner*—Samuel M. Heinrich
*Attorney, Agent, or Firm*—Herbert Furman

[57] ABSTRACT

A double pivot hinge for vehicle doors includes a hinge arm pivotally interconnecting door and vehicle mounted hinge butts. A first and second latch means are alternately movable between latched and unlatched positions to either latch the hinge arm to the door mounted hinge butt for movement of the door and hinge arm as a unit to the 90° open position or to latch the hinge arm to the vehicle mounted hinge butt for movement of the door relative to the hinge arm between 90° and 180° open positions. A detent means detents the first latch means in unlatched position during movement of the door between 90° and 180° open positions. The detent means is automatically released as the door moves from the 180° position to a position immediately adjacent the 90° open position to permit uninterrupted closing movement of the door.

3 Claims, 10 Drawing Figures

DOUBLE PIVOT HINGE

This invention relates generally to double pivot hinges for vehicle doors and more particularly to concealed type double pivot hinges which are operative to selectively locate the door in sequential 90° partial and 180° full open positions and permit uninterrupted closing movement of the door from the full open position to closed position.

Concealed double pivot hinges are known and have been used on production vehicles. Generally such hinges permit the cargo doors of a van type vehicle to be moved between closed position and various open positions. It is also known to provide double pivot hinges with yieldable hold open detents operative to locate the door in various open positions. U.S. Pat. No. 2,870,477 Anthony et al, Hinge, issued Jan. 27, 1959, and assigned to the assignee of this invention, discloses such a double pivot hinge with yieldable hold open detents.

In the double pivot hinge of this invention, the hinge arm is selectively and alternately latchable to either the vehicle mounted hinge butt or the door mounted hinge 112 that it can pivot about either of its pivots to such hinge butts but not about both pivots. In the preferred embodiment, a first latch means is operative to latch the hinge arm to the door mounted hinge butt and a second latch means is operative to latch the hinge arm to the vehicle mounted hinge butt. The first and second latch means are interconnected so that movement of one to latched position automatically or simultaneously moves the other to unlatched position. Normally the first latch means is in latched position so that the hinge arm and door move as a unit relative to the vehicle mounted hinge butt from closed position to a 90° or partial open position. When the first latch means is released or moved to unlatched position, the second latch means is simultaneously engaged or moved to latched position so that the door and door mounted hinge butt pivot relative to the hinge arm to the 180° or full open position. In order to provide for uninterrupted closing movement of the door from the full open position to the closed position, a releasable detent is mounted on the hinge arm and moved between detented and undetented positions with respect to the first latch means in accordance with the position of the hinge arm relative to the door mounted hinge butt. The detent detents the first latch means in released position whenever the door is in an open position between the 90° open position and the 180° open position. When the door moves from the 180° open position toward closed position, the detent undetents the first latch means for movement to engaged position when the door is in a position immediately adjacent the 90° open position. The first latch means latches the hinge arm to the door mounted hinge butt as the second latch means is simultaneously released so that uninterrupted closing movement of the door can occur.

One feature of this invention is that it provides a double pivot hinge having a hinge arm pivotally interconnecting door mounted and vehicle mounted hinge butts and releasably latchable by first and second latch means to either of the hinge butts to provide for movement of the door from a closed position to either a 90° or partial open position or a 180° or full open position. Another feature is that the first and second latch means are mounted on the hinge arm and are alternately engageable with a respective hinge butt to either latch the hinge arm to the door mounted hinge butt for movement of the hinge arm and door relative to the vehicle mounted hinge butt between closed position and partial open position or latch te hinge arm to the vehicle mounted hinge butt for movement of the door and door mounted hinge butt relative to the hinge arm for movement of the door between partial and full open positions. A further feature is that the first and second latch means are interconnected so that movement of one latch means to engaged or latched position simultaneously moves the the latch means to released or unlatched position. Yet another feature is that a detent detents the first latch means in released position when the door moves between the 90° open position and the 180° open position. Yet a further feature is that the detent releases the first latch means for movement to latched position when the door approaches the 90° open position so that uninterrupted closing movement of the door from the 180° open position can occur.

These and other features will be readily apparent from the following specification and drawings wherein.

Figure 9:
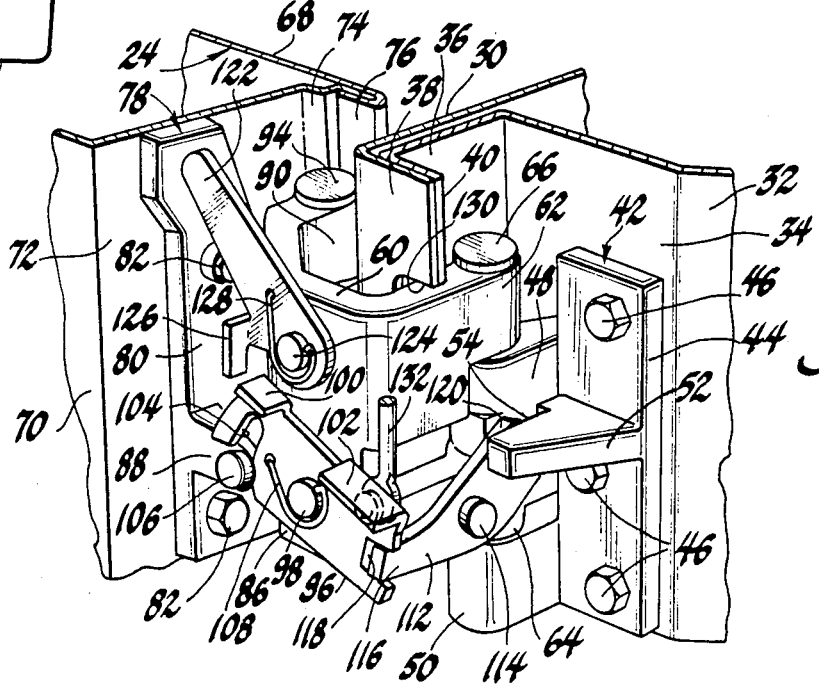
Figure 10:
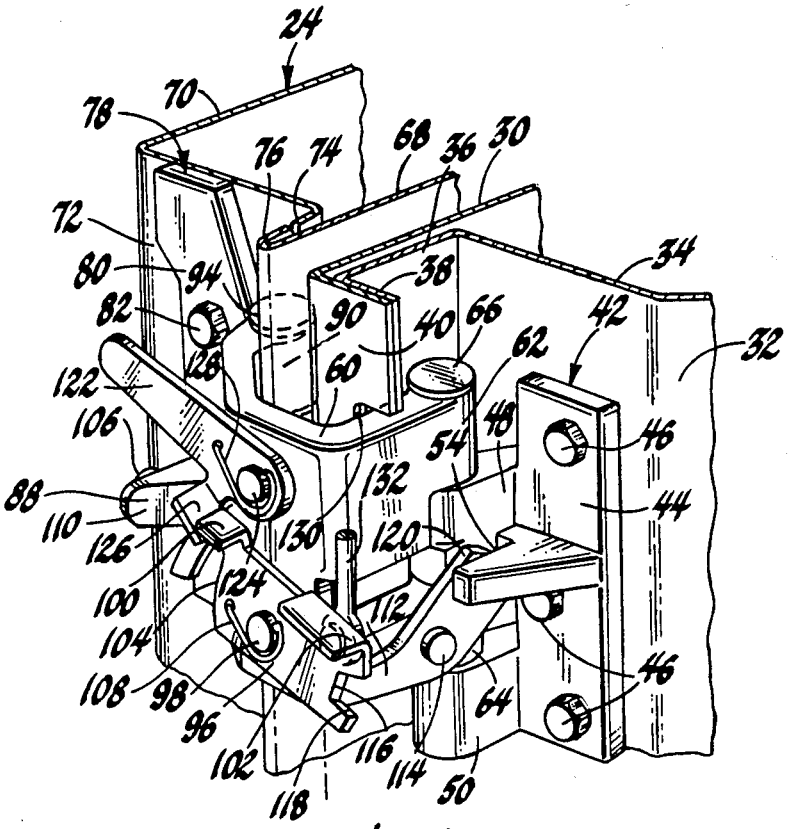

FIG. 9 is a view showing the door in the 90° open position with the first latch means being shown in released position and te second latch means in latched position preparatory to movement of the door to the 180° open position, and FIG. 10 is a view similar to FIG. 9 showing the door in the 180° open position.

Figure 1:
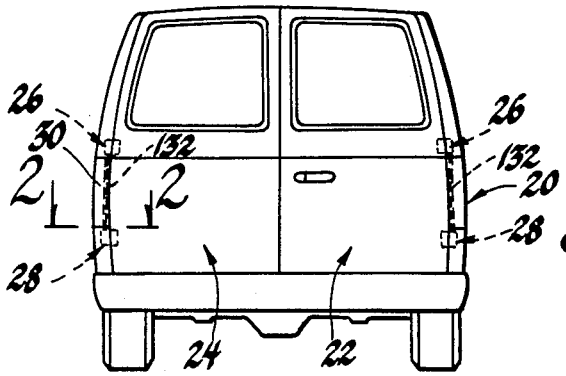
FIG. 1 is a rear view of a cargo type vehicle having rear doors mounted thereon by double pivot hinges according to this invention, with the doors being shown in closed position.

Referring now to FIG. 1 of the drawings, a cargo type vehicle 20 includes a pair of right hand and left hand conventional rear access doors 22 and 24 respectively. The right hand door overlaps the left hand door and is latched thereto when the doors are in closed position. The overlapped door is conventionally releasably latched to the vehicle. Each door is mounted to the vehicle 20 by upper and lower double pivot hinges 26 and 28. The hinges 26 and 28 are the same. Therefore, only the hinge 28 of the left hand door will now be described with reference to FIGS. 2 through 10 of the drawings.

Figure 2:
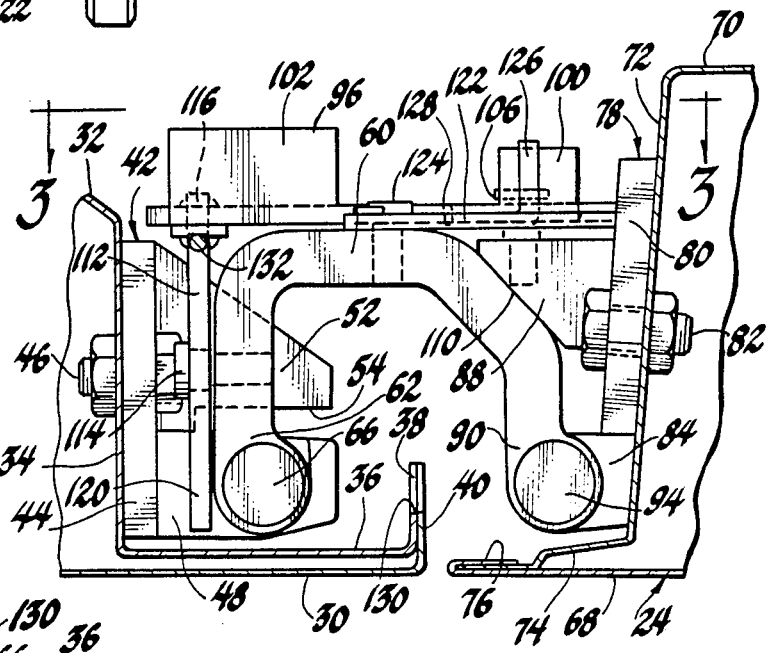
FIG. 2 is an enlarged sectional view taken on line 2—2 of FIG. 1.

As shown in FIG. 2, the vehicle 20 includes an outer panel 30 and an inner panel 32 having a hinge pillar wall 34. Wall 34 includes a flange 36 and a flange 38 which abuts and is welded to a like flange 40 of the panel 30. A vehicle mounted hinge butt 42 includes a base plate 44 which is bolted at 46 to the wall 34 of panel 32. The hinge butt 42 further includes upper and lower coaxially apertured ears 48 and 50 respectively and an intermediate generally triangularly shaped ear 52 which includes a notched wall spaced from a juxtaposed wall of ear 48 to provide a striker or latch receiving groove 54, FIG. 9.

A generally U-shaped hinge arm 60 includes a pair of coaxially apertured upper and lower ears 62 and 64 at one end thereof. A hinge pin 66 extends through the aligned apertures of the ears 62, 48, 64 and 50 to pivotally mount the one end of the hinge arm 60 to the vehicle mounted hinge butt 42.

Figure 4:
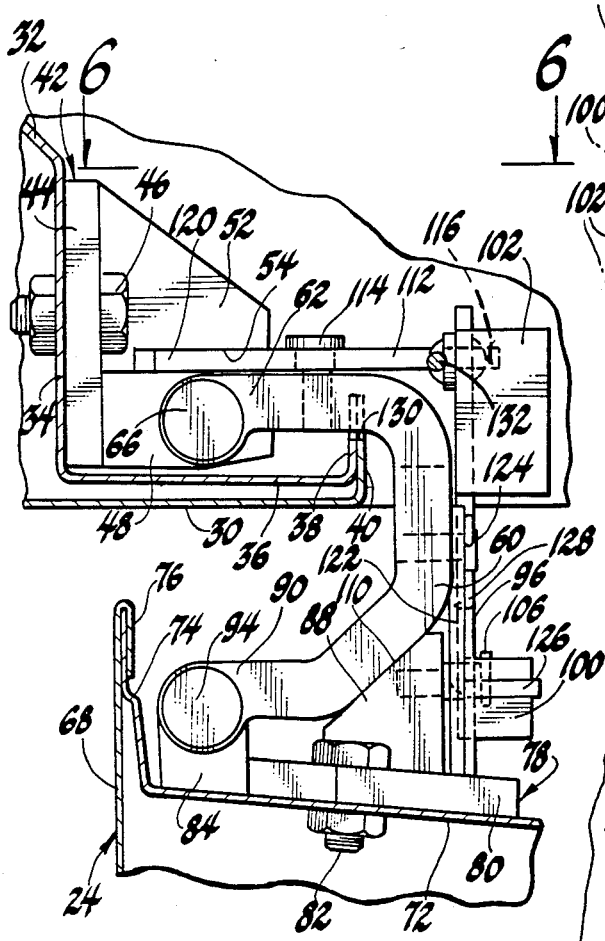
FIG. 4 is a view similar to FIG. 2 and showing the hinge in the 90° open position of the door.

As shown in FIGS. 2 and 4, the door 24 includes a door outer panel 68 and a door inner panel 70 having a pillar wall 72 which terminates in an offset flange 74 hem flanged at 76 to the outer panel 68 of the door. A door mounted hinge butt 78 includes a base 80 which is bolted at 82 to the pillar wall 72 of the door. The hinge butt 78 further includes upper and lower coaxially apertured ears 84 and 86 respectively and an intermediate lateral ear 88 therebetween.

The other end of the hinge arm 60 includes upper and lower coaxially apertured ears 90 and 92 respectively. A hinge pin 94 pivotally connects the aligned apertured ears 90, 84, 92 and 86 to pivotally mount the door 24 to the hinge arm 60. A first latch arm 96 is pivoted at 98, intermediate the ends thereof, to the hinge arm 60. The latch arm includes first and second lateral tabs 100 and 102 and an arcuate notch 104 at one end thereof under tab 100. When the latch arm 96 is in its engaged or latched position as shown in FIGS. 2, 3, 4 and 8, the notch 104 engages the shank of a headed stud or pin 106 extending inwardly of door 24 or forwardly of the vehicle from the ear 88. A coil spring 108 biases the latch arm 96 counterclockwise of pivot 98. The latch arm 96 and the stud 106 provide a first latch means for latching the hinge arm 60 to the door mounted hinge butt 78. The hinge arm and hinge butt are located relative to each other by engagement of an angular portion of the hinge arm with an angular face 110 of ear 88, FIGS. 2 and 4.

Figure 6:
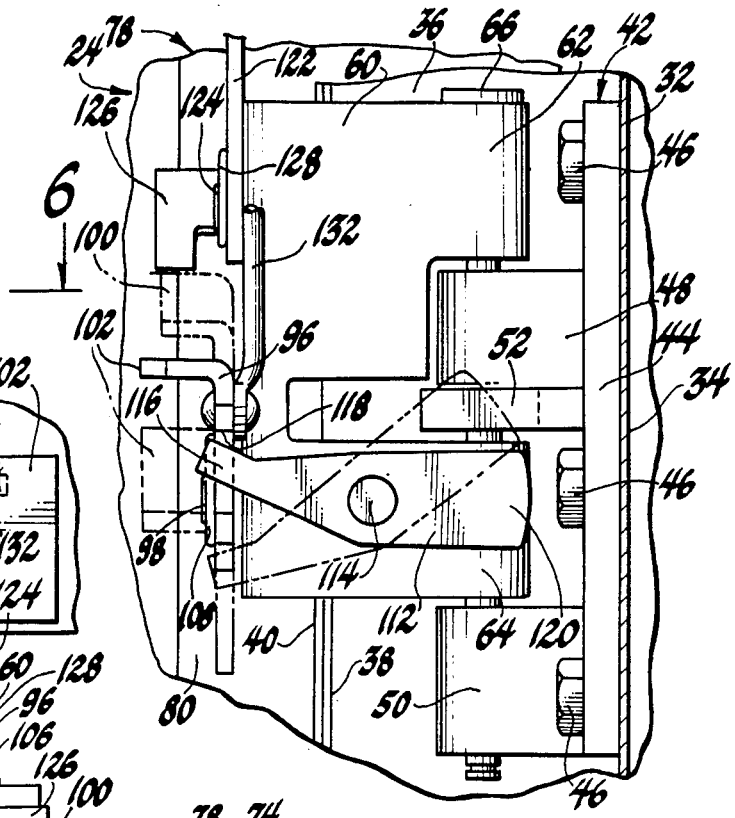
FIG. 6 is a view taken on line 6—6 of FIG. 4 and showing the second latch means in full lines in unlatched position and in dash lines in latched position.

A second latch arm 112 is pivoted at 114 intermediate the ends thereof to the lower apertured ear 64 of the hinge arm 60 as best shown in FIG. 6. One end 116 of arm 112 is received within a notch 118 in the other end of the latch arm 96 to coupler or interconnect the first and second latch arms 96 and 112. The other end 120 of arm 112 is receivable in the groove 54 when the latch arm 112 is in engaged or latched position as shown in FIGS. 9 and 10, as will be described.

Figure 3:
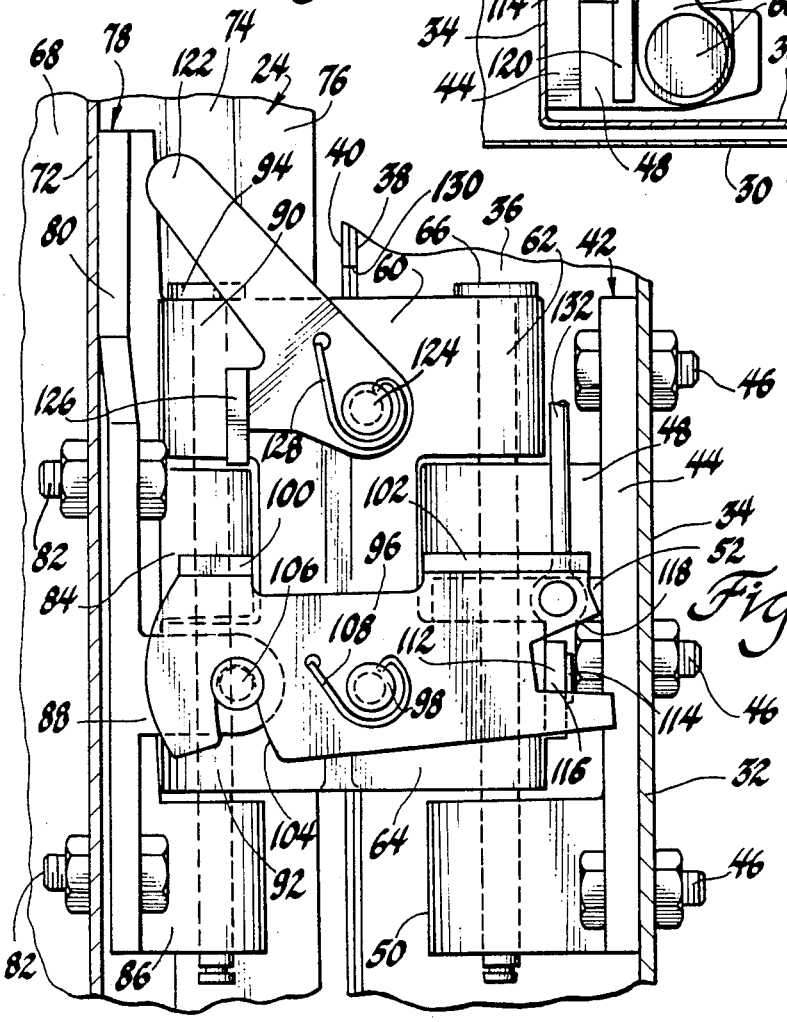
FIG. 3 is an enlarged view taken on line 3—3 of FIG. 2.

A detent lever 122 is pivoted at 124 to the hinge arm 60 as best shown in FIG. 3. The longer leg of the detent lever is engageable with the base 80 of the door mounted hinge butt 78 for a purpose to be described. The shorter leg of the detent lever includes a lateral tab 126. A coil spring 128 around pivot 124 normally biases the detent lever 122 counterclockwise about the pivot 124.

When the door 24 is in the closed position as shown in FIGS. 2 and 3, the latch arm 96 has its notch 104 engaged with the shank of pin 106 under the bias of the spring 108 to latch the hinge arm 60 to the door mounted hinge butt 42. The spring 128 biases the detent lever 122 counterclockwise so that the end of the longer leg of the detent engages the base 80 of the hinge butt 78. The engagement of notch 118 of the latch arm 96 with the end 116 of latch arm 112 locates the latch arm 112 in its unlatched or released position shown in full lines in FIG. 6.

If it is desired to open the door 24 to its 90° open position, the various conventional latches between doors 22 and 24 and between door 24 and vehicle 20 are released and the door 24 is then manually moved to its 90° open position. During this movement, the door 24, the hinge butt 78, the hinge arm 60, the latch arms 96 and 112 and the detent 122 move as a unit relative to the hinge butt 42 and vehicle 20 as the apertured ears 62 and 64 pivot about the hinge pin 66. As shown in FIGS. 4 and 9, the hinge arm 60 engages in a notch 130 of flanges 38 and 40 or against a rubber bumper mounted on such flanges of panels 30 and 32 to locate the door in the 90° open position. The door can be closed from the 90° open position by swinging it in the opposite direction about the hinge pin 66.

Figure 5:
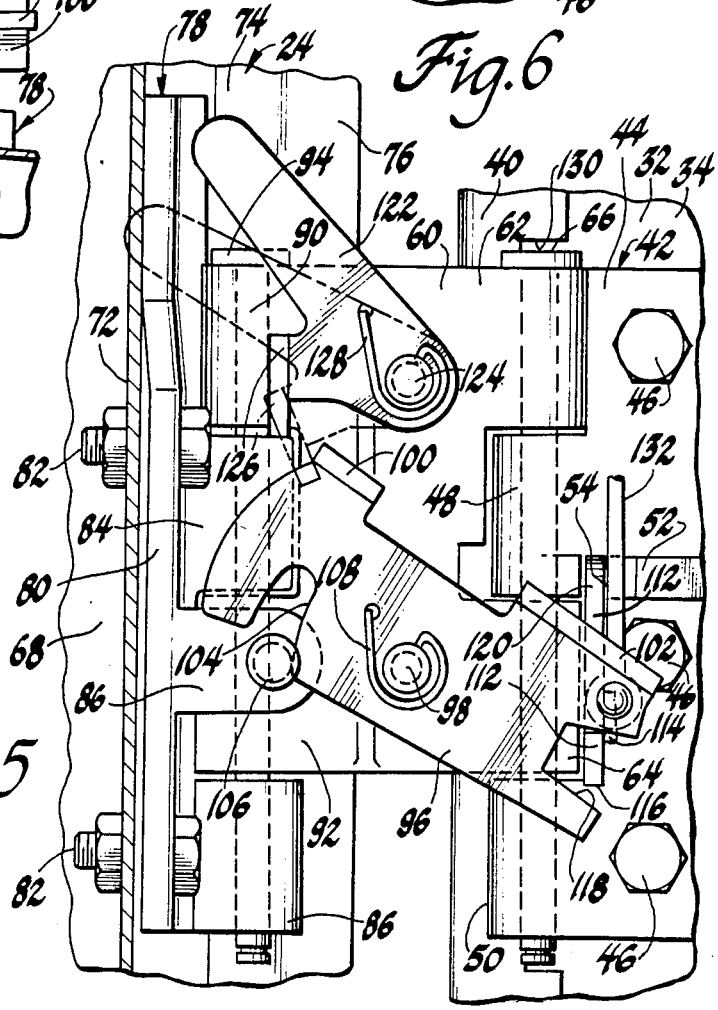
FIG. 5 is a view similar to FIG. 3 and showing the first latch means in a released position and the detent means in an undetented position in full lines and in a detented position in dash lines.
Figure 7:
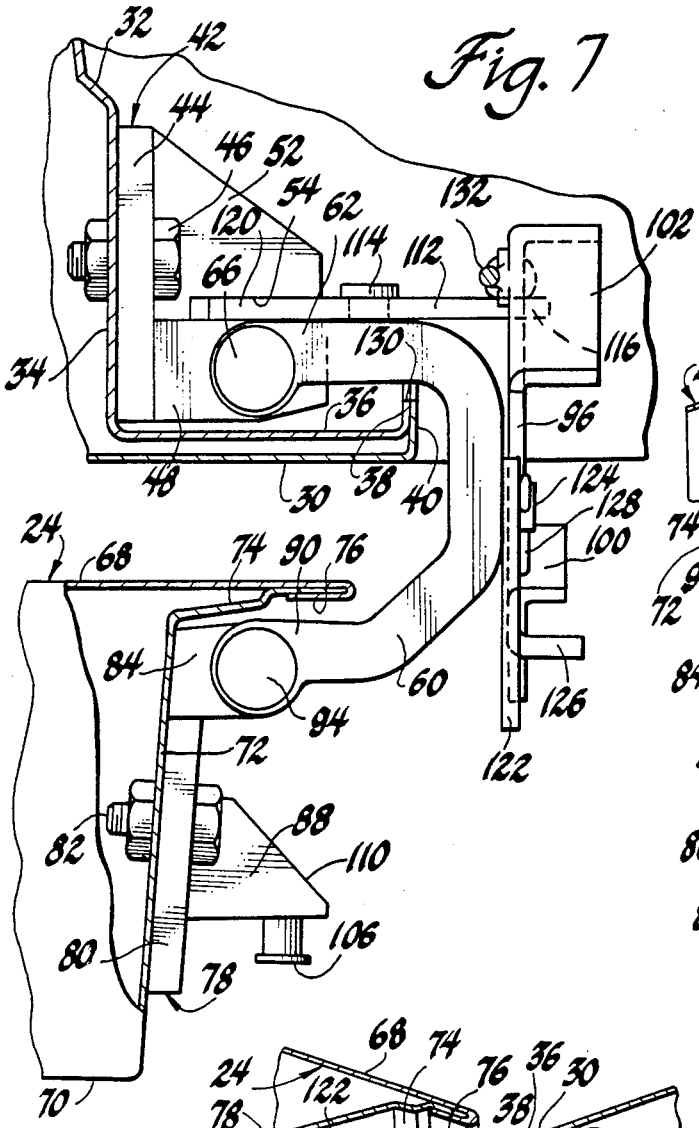
FIG. 7 is a view similar to FIGS. 2 and 4 and showing the hinge in the 180° open position of the door.
Figure 8:
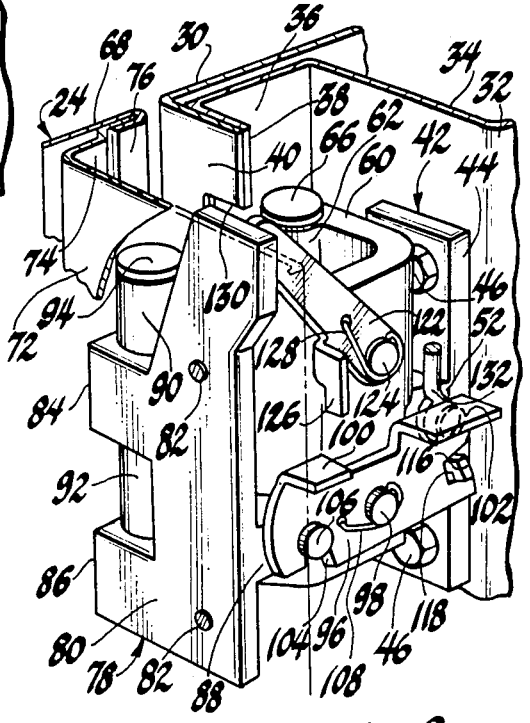
FIG. 8 is a perspective view of the door in the closed position.

If it is desired to move the door 24 from the 90° open position to the 180° open position, FIGS. 7 and 10, the tab 100 of the latch arm 96 is manually grasped and the latch arm rotated clockwise as viewed in FIGS. 5 and 9 to its released or unlatched position shown therein. This releases notch 104 from the shank of pin 106 to disconnect door 24 and hinge butt 78 from hinge arm 60. The engagement of notch 118 of the latch arm 96 with the one end 116 of latch arm 112 rotates latch arm 112 counterclockwise as viewed in FIG. 6 from its full line released or unlatched position shown therein to its latched position shown in dash lines in FIG. 16 and in full lines in FIGS. 9 and 10 wherein the other end 120 of the latch arm 112 engages in the groove 54 to latch the hinge arm 60 to the hinge butt 42. This releases the door 24 and the hinge butt 42 for rotation relative to the hinge arm 60 about the hinge pin 94. Upon initial movement of the door 24 from the 90° open position toward the 180° open position, the base 86 of the hinge butt 78 disengages from the longer arm of detent lever 122 and spring 128 rotates the detent lever counterclockwise as viewed in FIGS. 3, 5, and 9 from its undetented position shown therein to its detented position shown in full lines in FIG. 10 and in dash lines in FIG. 5 where the tab 126 of the detent 122 engages underneath the tab 100 of latch arm 96 to detent this latch arm in its released position when the tab 100 is manually released. Thereafter, movement of the door continues from the 90° open position to the 180° open position as shown in FIGS. 7 and 10.

When the door is manually moved from the 180° open position toward closed position, the base 80 of hinge butt 78 engages the longer leg of detent 122 when the door is in a position immediately adjacent the 90° open position. This rotates the detent 122 clockwise as viewed in FIG. 5 from its dash line detent position to its full line undetented position shown therein and in FIG. 9. This releases the latch arm 96 for spring biased movement to its latched position wherein the notch 104 thereof engages the shank of the pin 106 to again latch the hinge arm 60 to the door mounted hinge butt 78 and move the latch arm 112 from its latched position shown in FIG. 9 and in dash lines in FIG. 6 to its unloaded position shown in the latter Figure. This uninterrupted closing movement of the door from its 90° open position to its closed position can continue.

Rod 132 is pivoted at each end thereof to the latch arms 96 of both the left hand and right hand pairs of hinges 26 and 28 to provide for simultaneous movement thereof.

Thus this invention provides an improved double pivot hinge for vehicle doors.

The embodiments of the invention in which an exclusive property or privilege is claimed are defined as follows:

1. A double pivot hinge for swingably mounting a closure on a vehicle for movement of the closure between closed, intermediate open, and full open positions comprising, in combination, a hinge arm, first means pivotally connecting the hinge arm to the vehicle for pivotal movement relative thereto about a first pivotal axis, second means pivotally connecting the hinge arm to the closure for pivotal movement of the hinge arm relative thereto about a second pivotal axis, first latch means movable between (1) a latched position wherein the first latch means latches the hinge arm to the closure for pivotal movement of the hinge arm and closure as a unit about the first pivotal axis relative to the vehicle between closed and intermediate open positions, and (2) an unlatched position wherein the first latch means unlatches the closure and hinge arm for movement of the closure relative to the hinge arm about the second pivotal axis, second latch means movable between (1) a latched position wherein the second latch means latches the hinge arm to the vehicle for pivotal movement of the closure relative to the hinge arm between intermediate open position and full open position about the second pivotal axis, and (2) an unlatched position wherein the second latch means permits movement of the hinge arm relative to the vehicle about the first pivotal axis, and means interconnecting the first and second latch means for moving one latch means to unlatched position upon movement of the other latch means to latched position to permit pivotal movement of the closure about only one pivotal axis.

2. A double pivot hinge for swingably mounting a closure on a vehicle for movement of the closure between closed, intermediate open, and full open positions comprising, in combination, a hinge arm, first means pivotally connecting the hinge arm to the vehicle for pivotal movement relative thereto about a first pivotal axis, second means pivotally connecting the hinge arm to the closure for pivotal movement of the hinge arm relative thereto about a second pivotal axis, first latch means movable between (1) a latched position wherein the first latch means latches the hinge arm to the closure for pivotal movement of the hinge arm and closure as a unit about the first pivotal axis relative to the vehicle between closed and intermediate open positions, and (2) an unlatched position wherein the first latch means unlatches the closure and hinge arm for movement of the closure relative to the hinge arm about the second pivotal axis, second latch means movable between (1) a latched position wherein the second latch means latches the hinge arm to the vehicle for pivotal movement of the closure relative to the hinge arm between intermediate open position and full open position about the second pivotal axis, and (2) an unlatched position wherein the second latch means permits movement of the hinge arm relative to the vehicle about the first pivotal axis, and means maintaining one latch means in unlatched position whenever the other latch means is in latched position to thereby block simultaneous pivotal movement of the closure about both first and second pivotal axes.

3. A double pivot hinge for swingably mounting a closure on a vehicle for movement of the closure between closed, intermediate open, and full open positions comprising, in combination, a hinge arm, first means pivotally connecting the hinge arm to the vehicle for pivotal movement relative thereto about a first pivotal axis, second means pivotally connecting the hinge arm to the closure for pivotal movement of the hinge arm relative thereto about a second pivotal axis, first latch means movable between (1) a latched position wherein the first latch means latches the hinge arm to the closure for pivotal movement of the hinge arm and closure as a unit about the first pivotal axis relative to the vehicle between closed and intermediate open positions, and (2) an unlatched position wherein the first latch means unlatches the closure and hinge arm for movement of the closure relative to the hinge arm about the second pivotal axis, second latch means movable between (1) a latched position wherein the second latch means latches the hinge arm to the vehicle for pivotal movement of the closure relative to the hinge arm between intermediate open position and full open position about the second pivotal axis, and (2) an unlatched position wherein the second latch means permits movement of the hinge arm relative to the vehicle about the first pivotal axis, and means interconnecting the first and second latch means for moving one latch means to unlatched position upon movement of the other latch means to latched position to permit pivotal movement of the closure about only one pivotal axis, means blocking movement of the first latch means to latched position when the closure is in any open position between full open position and an open position immediately adjacent the intermediate open position, and means for releasing the blocking means upon movement of the closure to the open position immediately adjacent the intermediate open position to permit uninterrupted movement of the closure from full open position to closed position.

* * * * *